US008032968B2

(12) United States Patent
Şekercioğlu et al.

(10) Patent No.: US 8,032,968 B2
(45) Date of Patent: Oct. 11, 2011

(54) SLOTTED TOOTHBRUSH BODY AND NECK

(75) Inventors: Kunter Şekercioğlu, Istanbul (TR); Şerife Özüm Özkan, Istanbul (TR)

(73) Assignee: Banat Firca Ve Plastik Sanayi Anonim Sirketi, Istanbul (TR)

( * ) Notice: Subject to any disclaimer, the term of this patent is extended or adjusted under 35 U.S.C. 154(b) by 704 days.

(21) Appl. No.: 12/021,236

(22) Filed: Jan. 28, 2008

(65) Prior Publication Data

US 2008/0178406 A1 Jul. 31, 2008

(30) Foreign Application Priority Data

Jan. 30, 2007 (TR) ..... U 2007 00499
Jan. 30, 2007 (TR) ..... U 2007 00500

(51) Int. Cl.
*A46B 5/02* (2006.01)
*A46B 9/04* (2006.01)

(52) U.S. Cl. ..... 15/143.1; 15/167.1

(58) Field of Classification Search ..... 15/143.1, 15/167.1, 145, 172; *A46B 5/02, 9/04*
See application file for complete search history.

(56) References Cited

U.S. PATENT DOCUMENTS

| | | | | | |
|---|---|---|---|---|---|
| D192,239 | S | * | 2/1962 | Corbino | D4/108 |
| 4,520,526 | A | * | 6/1985 | Peters | 15/167.1 |
| D388,254 | S | * | 12/1997 | Schiffer | D4/107 |
| D414,937 | S | * | 10/1999 | Cornu et al. | D4/104 |
| 2009/0188063 | A1 | * | 7/2009 | Baertschi et al. | 15/167.1 |

* cited by examiner

*Primary Examiner* — Monica Carter
*Assistant Examiner* — Stephanie Newton
(74) *Attorney, Agent, or Firm* — Egbert Law Offices PLLC

(57) ABSTRACT

Present invention relates to a slotted toothbrush body and neck. The toothbrush body has an elastomer part with a PP part and adhesion legs. The adhesion legs have surfaces in contact with a toothbrush holder/glass. There are PP bridges forming the toothbrush neck, and an elastomer section supports the bridges forming the toothbrush neck. Teeth are better cleaned, and gingival get less deteriorated by pivotal movement of the head in the front and back direction and right and left direction. Also, the toothbrush can be secured to the toothbrush holder/glass edge without contacting other toothbrushes.

1 Claim, 7 Drawing Sheets

SLOTTED TOOTHBRUSH BODY AND NECK

CROSS-REFERENCE TO RELATED APPLICATIONS

Not applicable.

STATEMENT REGARDING FEDERALLY SPONSORED RESEARCH OR DEVELOPMENT

Not applicable.

NAMES OF THE PARTIES TO A JOINT RESEARCH AGREEMENT

Not applicable.

INCORPORATION-BY-REFERENCE OF MATERIALS SUBMITTED ON A COMPACT DISC

Not applicable.

BACKGROUND OF THE INVENTION

1. Field of the Invention

The present invention related to a slotted toothbrush body and neck.

2. Description of Related Art Including Information Disclosed Under 37 CFR 1.97 and 37 CFR 1.98

The toothbrushes currently available on the market consists of an integral body and are preserved by being placed within toothbrush holders or glasses (4). This leads to hygiene problems due to contact between head sections of the toothbrushes. Furthermore, currently available toothbrush necks only include single-way stretching models. No stretch action from front to back or from right to left is possible.

BRIEF SUMMARY OF THE INVENTION

Present invention relates to a slotted toothbrush body and neck. The elastomer part (1) of the toothbrush body consists of PP part (2) and adhesion legs (3). The adhesion legs (3) of toothbrush body allow placement on the toothbrush holder/glass, and surfaces of the toothbrush body adhesion legs contact the toothbrush holder/glass (4). PP bridges (6) form the toothbrush neck, and the elastomer section (7) supports the bridges forming the toothbrush neck.

In the present invention, pivotally moving the head of a toothbrush in front and back and right and left directions is enabled so that the teeth are better cleaned and gums are less likely to deteriorate. Also, toothbrushes are secured to a toothbrush holder/glass (4) edge without contacting other toothbrushes for better hygiene.

BRIEF DESCRIPTION OF THE SEVERAL VIEWS OF THE DRAWINGS

The toothbrush body of the present invention is displayed in following appended drawings.

DETAILED DESCRIPTION OF THE INVENTION

Figure 1:
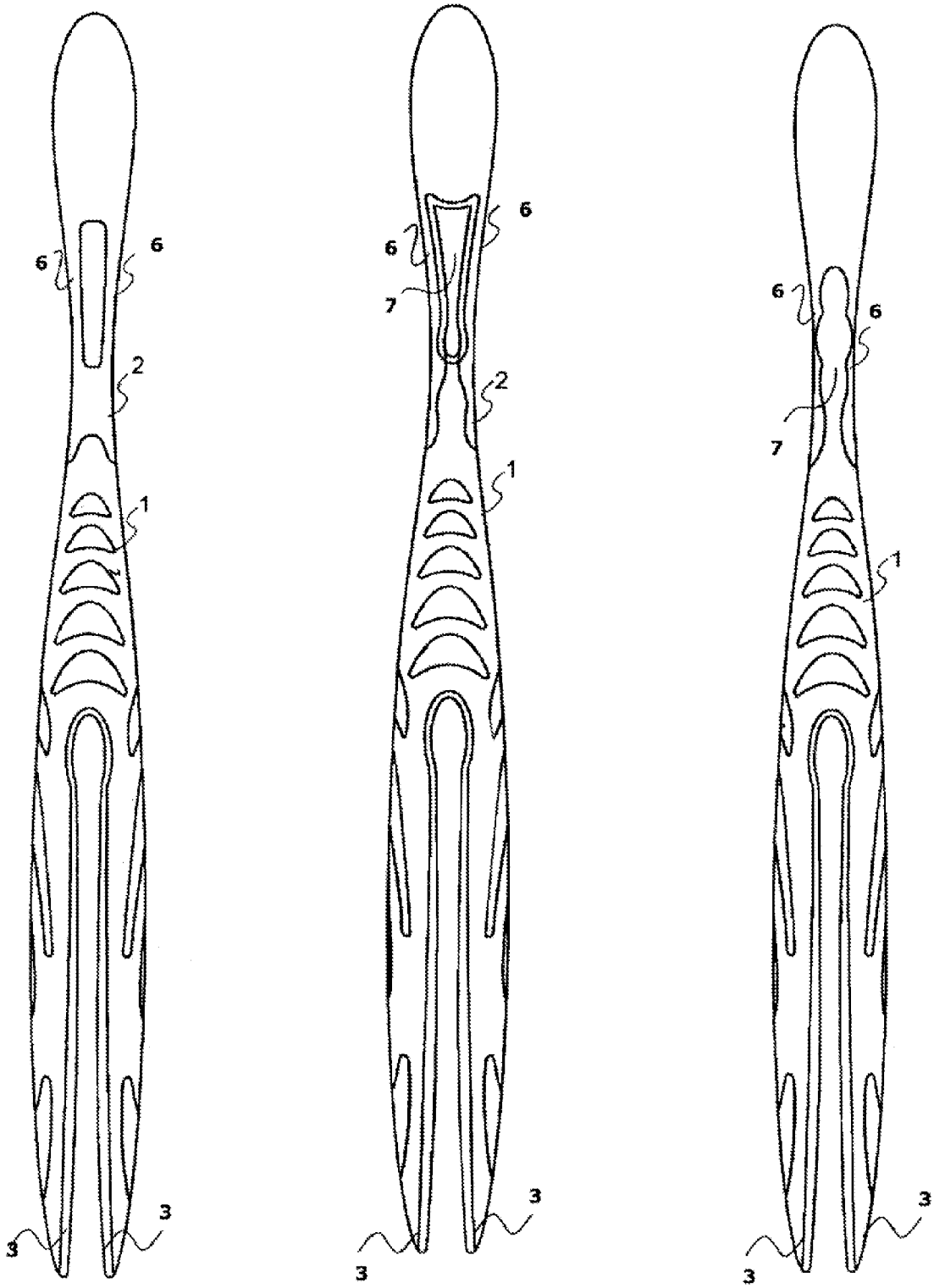
FIG. 1 shows various back views of the toothbrush.
Figure 2:
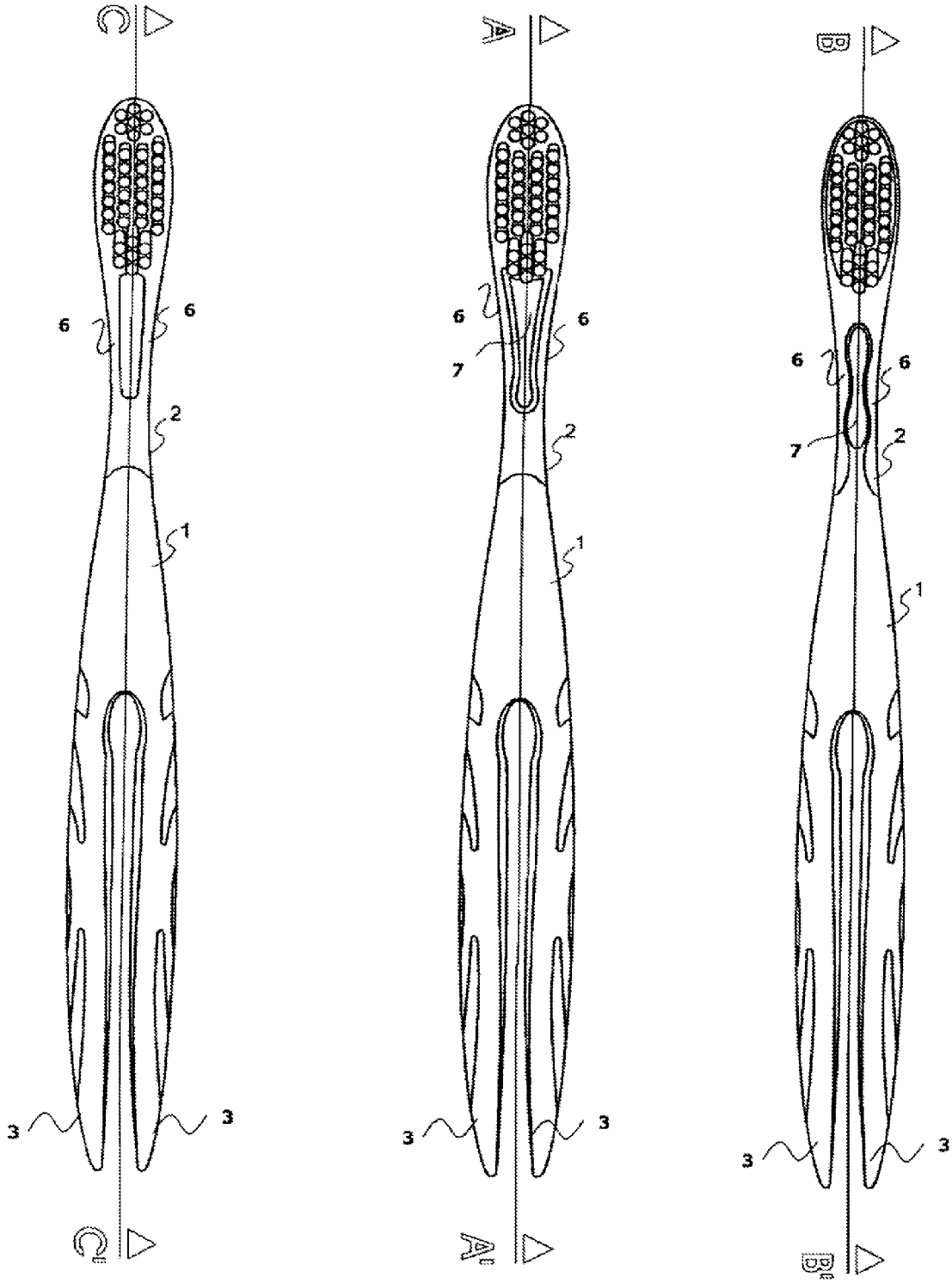
FIG. 2 shows front views of the toothbrush.
Figure 3:
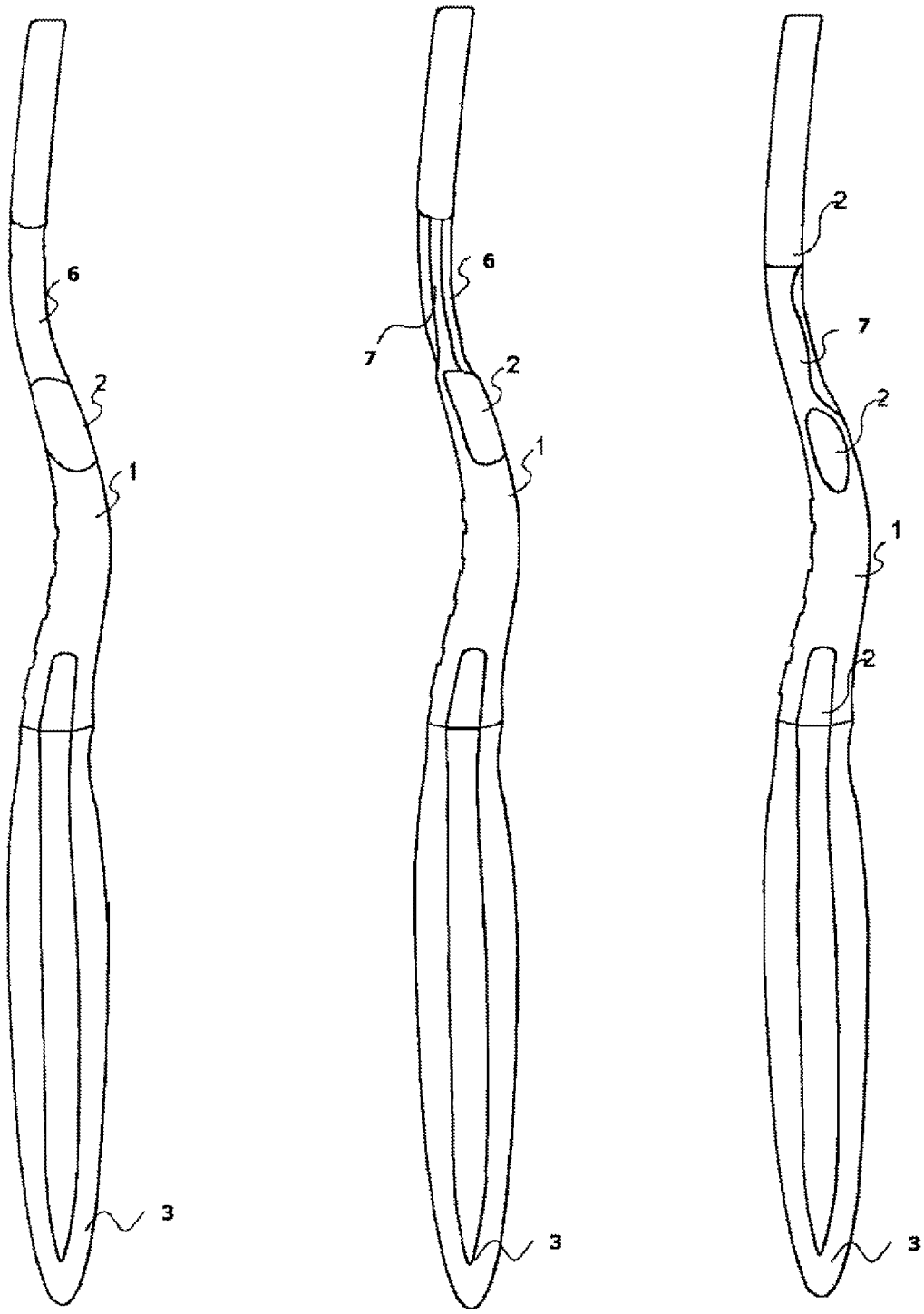
FIG. 3 shows side views of the toothbrush.
Figure 4:
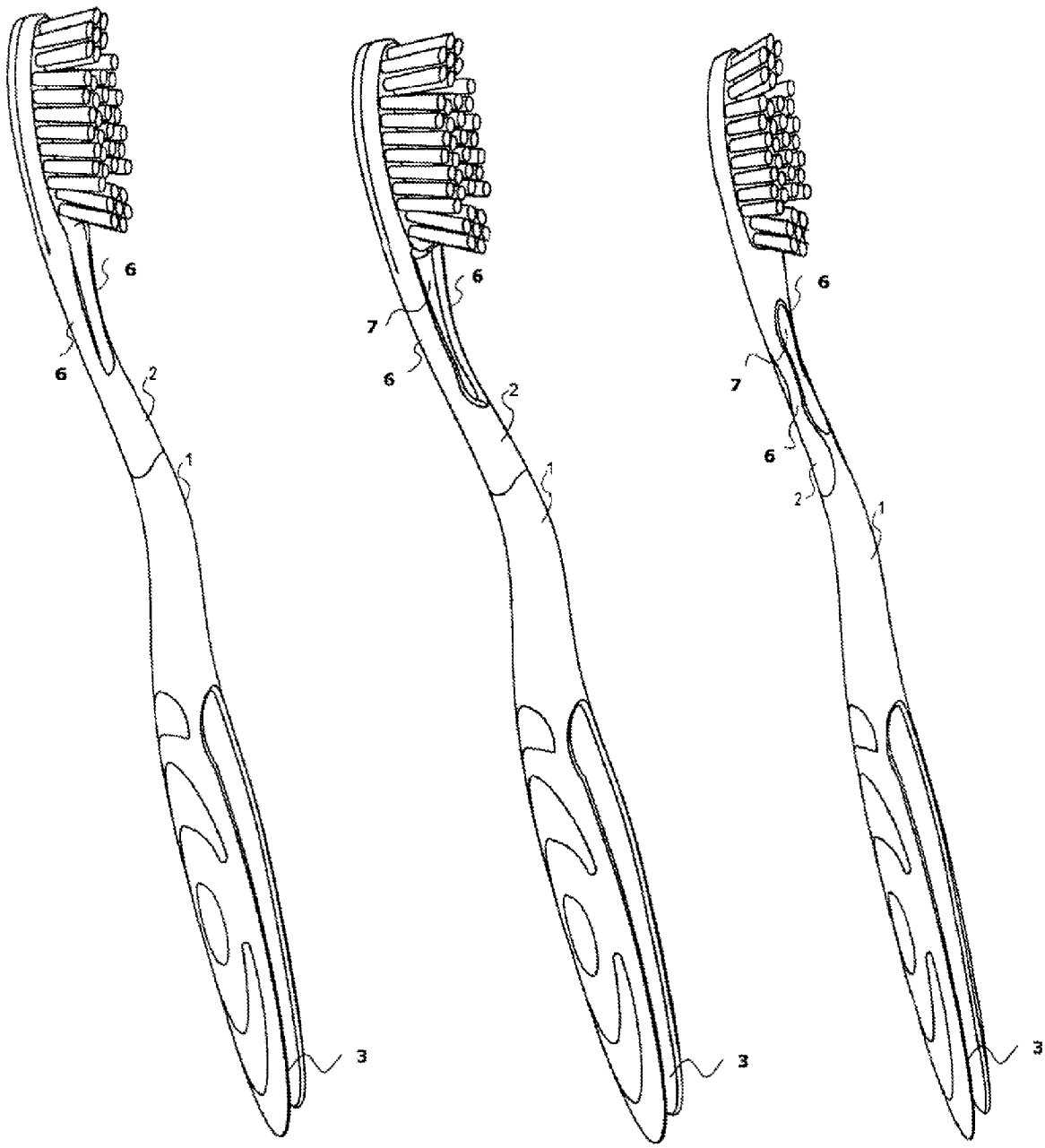
FIG. 4 shows a perspective view of the toothbrush.
Figure 5:
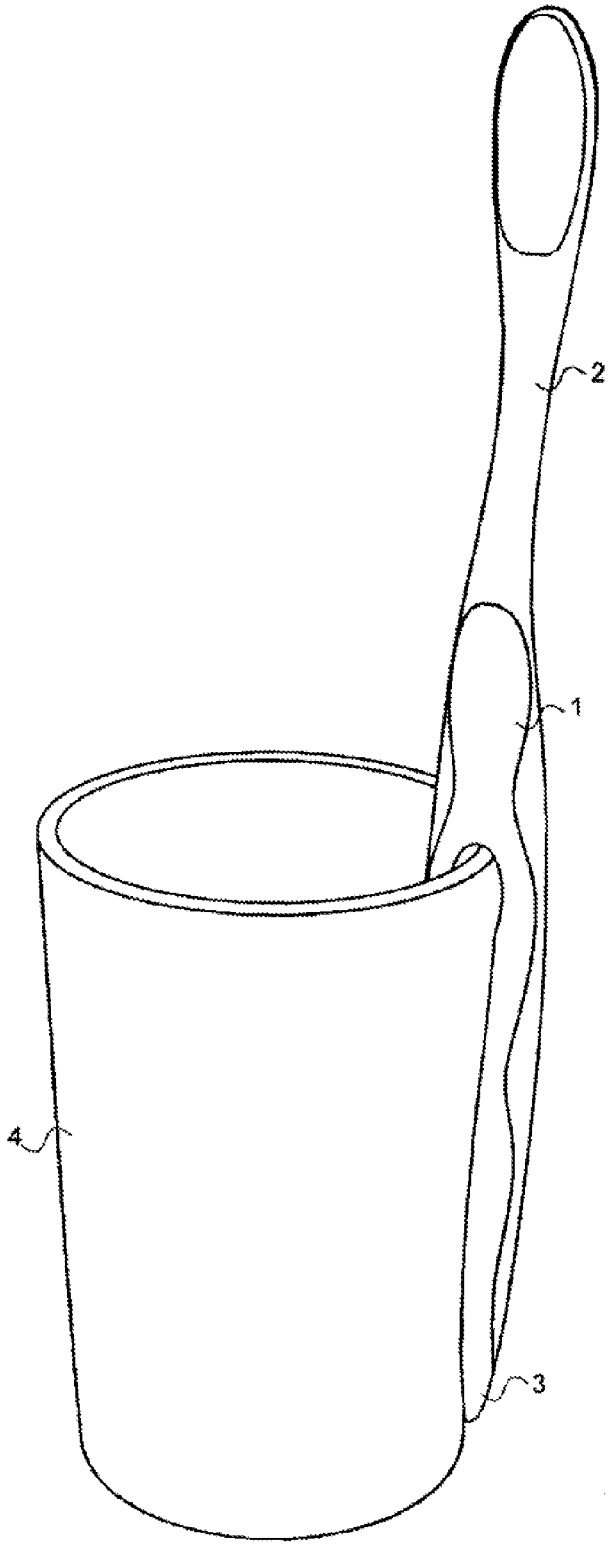
FIG. 5 shows a perspective view the toothbrush placed on a glass.
Figure 6:
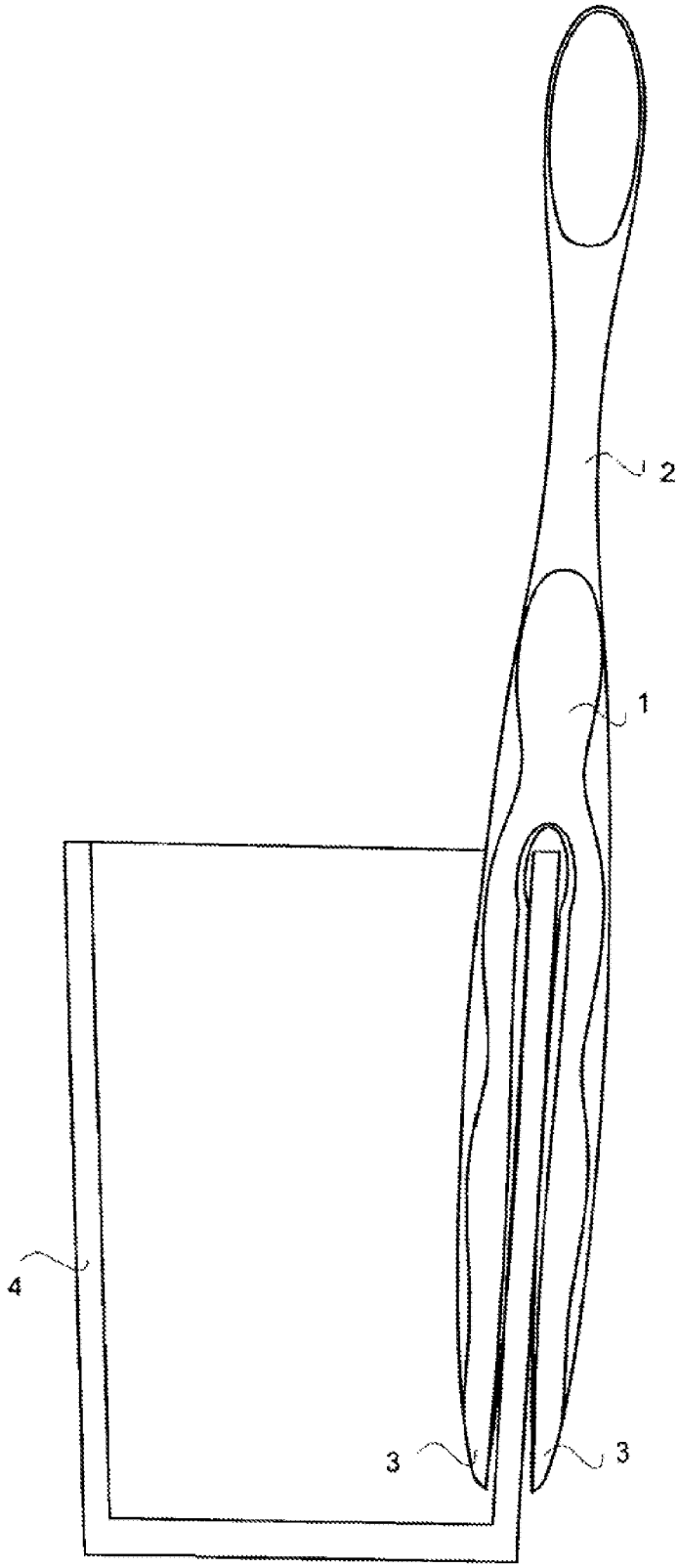
FIG. 6 shows a front view of the toothbrush body on the glass.
Figure 7:
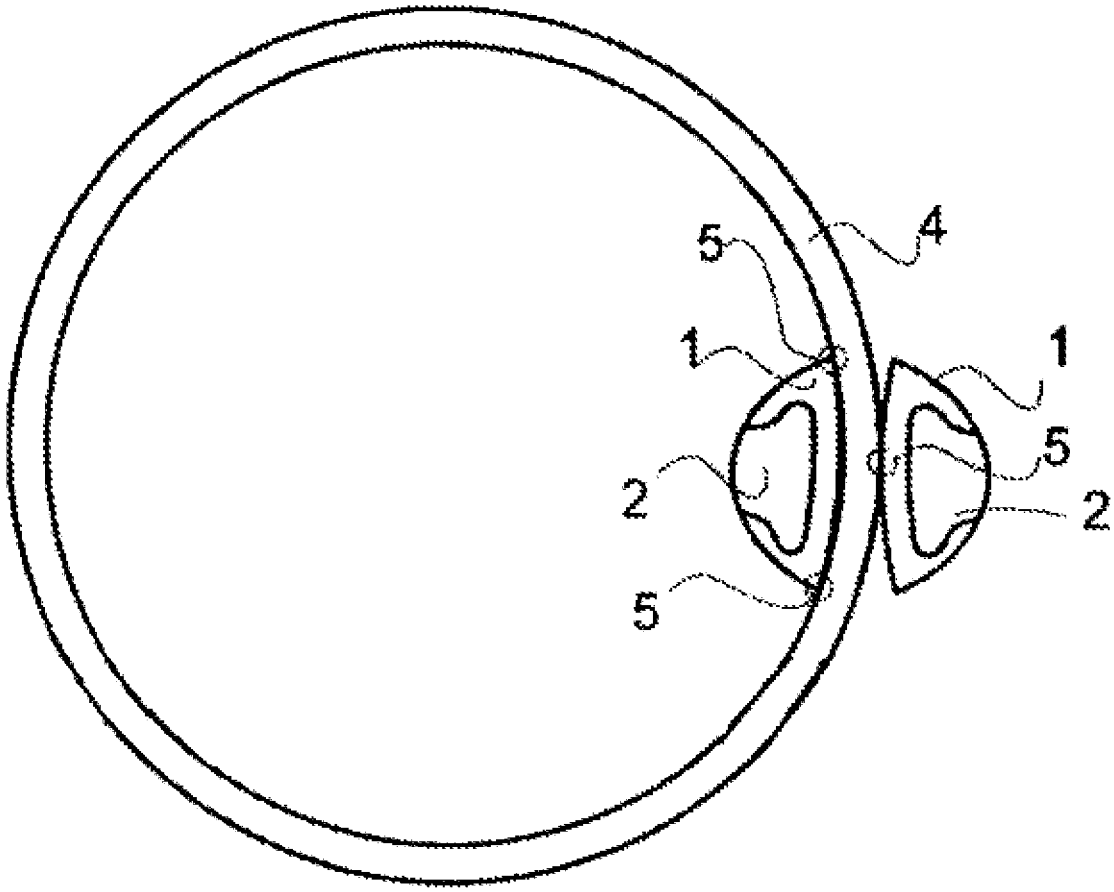
FIG. 7 shows a sectional view of the contact between toothbrush body and the glass.

In the present invention, a slot is being formed on the handle of the toothbrush, and the body is divided into two symmetric parts. Thus, toothbrush may be hanged onto the toothbrush holder/glass (4) and therefore, the possibility of head parts of toothbrushes contacting each other within the toothbrush holder/glass (4) is minimized.

Moreover, a slot is formed on the neck of the toothbrush, and the connection of the body to the head is enabled by two parallel PP bridges (6). As a result of pressure being applied during brushing, these two bridges (6) reduce the damage that may be caused to gingival by bristles on the head by making right and left bending at the body axis.

The toothbrush body is manufactured by double injection and consists of PP and elastomer sections (1, 2).

Securing the toothbrush body to the toothbrush holder/glass (4) is enabled by creating two holding legs (3) thanks to the slot formed on the body. The elastomer section (1) is located on the surfaces (5) of the holding legs (3), where the holding legs (3) contact the toothbrush holder/glass (4). The cylinder form of the toothbrush holder/glass (4) avoids the brush being slid transversely.

Furthermore, the toothbrush neck consists of two bridges (6) obtained by separation of the PP section connecting the body and the head through a slot. This neck made of PP material is being separated into two more flexible bridges (6) through this slot. Also, double injection and elastomer support (7) between PP bridges is possible. The front and back action may be facilitated by the elastomer section encompassing PP bridges.

The figures are numbered as follows:

(1) is the elastomer section of the toothbrush body;

(2) is the PP section of the toothbrush body;

(3) shows holding legs of the toothbrush body on the toothbrush holder/glass;

(4) is the toothbrush holder/glass;

(5) show the contact surfaces of the toothbrush body holding legs on the toothbrush holder/glass;

(6) are PP bridges forming the toothbrush neck; and (7) is the elastomer section supporting bridges that form the toothbrush neck.

We claim:

1. A toothbrush comprising:

a body formed of an elastomeric material, said body having a pair of legs at one end thereof, said pair of legs being spaced in generally parallel relation to each other so as to allow said body to be secured to a rim of a container;

a neck connected to an opposite end of said body, said neck having a first bridge and a second bridge with an open space therebetween, said first bridge and said second bridge being in generally parallel relation to each other, said first and second bridges being formed of a polypropylene material; and a head having bristles thereon, said head connected to said neck at an end opposite said body, said first and second bridges being sufficiently flexible so as to allow said head to bend back-and-forth, said open space of said neck being positioned away from said bristles of said head, said open space opening on a same side of said neck as a side of said bristles of said head and opening on another side of said neck opposite said bristles of said head.

* * * * *